US010679574B2

(12) United States Patent
Nakanishi et al.

(10) Patent No.: US 10,679,574 B2
(45) Date of Patent: Jun. 9, 2020

(54) LIQUID CRYSTAL DISPLAY DEVICE

(71) Applicant: Panasonic Liquid Crystal Display Co., Ltd., Himeji-shi, Hyogo (JP)

(72) Inventors: Hideyuki Nakanishi, Hyogo (JP); Toshikazu Koudo, Hyogo (JP); Katsuhiro Kikuchi, Hyogo (JP)

(73) Assignee: Panasonic Liquid Crystal Display Co., Ltd., Hyogo (JP)

( * ) Notice: Subject to any disclaimer, the term of this patent is extended or adjusted under 35 U.S.C. 154(b) by 42 days.

(21) Appl. No.: 15/942,073

(22) Filed: Mar. 30, 2018

(65) Prior Publication Data

US 2018/0286328 A1 Oct. 4, 2018

(30) Foreign Application Priority Data

Mar. 30, 2017 (JP) ..... 2017-068369

(51) Int. Cl.
*G09G 3/36* (2006.01)
*G09G 3/20* (2006.01)

(52) U.S. Cl.
CPC ..... *G09G 3/3607* (2013.01); *G09G 3/2051* (2013.01); *G09G 3/3688* (2013.01); *G09G 2300/023* (2013.01); *G09G 2310/027* (2013.01); *G09G 2320/0276* (2013.01); *G09G 2320/0673* (2013.01); *G09G 2340/0435* (2013.01); *G09G 2340/06* (2013.01)

(58) Field of Classification Search
CPC ..... G09G 3/3607; G09G 3/2051; G09G 2300/023; G09G 2320/0276; G09G 2320/0673; G09G 2340/06
See application file for complete search history.

(56) References Cited

U.S. PATENT DOCUMENTS

2009/0284518 A1* 11/2009 Sawabe ..... G02F 1/133528 345/213
2010/0002018 A1* 1/2010 Hirata ..... G09G 5/028 345/690
2012/0056911 A1* 3/2012 Safaee-Rad ..... G09G 3/2003 345/690

(Continued)

FOREIGN PATENT DOCUMENTS

JP 2008-191269 8/2008

*Primary Examiner* — Grace Q Li

(74) *Attorney, Agent, or Firm* — Hamre, Schumann, Mueller & Larson, P.C.

(57) ABSTRACT

A LCD device of display panels includes n-bit (n<m) driving first display panel that displays first image based on m-bit input image data, n-bit driving second display panel that displays second image based on the m-bit input image data, and image processor including first gradation converter that converts gradation of the m-bit input image data into n-bit gradation, second gradation converter that converts gradation of the m-bit input image data into m1-bit (m1≥m) gradation, and extension processor that performs extension processing of extending gradation expression with the n bits on the input image data converted into the m1-bit gradation. The n-bit driving first display panel displays the first image based on the n-bit input image data, and the n-bit driving second display panel displays the second image based on the n-bit input image data subjected to the extension processing.

5 Claims, 16 Drawing Sheets

(56) References Cited

U.S. PATENT DOCUMENTS

| | | | | |
|---|---|---|---|---|
| 2012/0281008 | A1* | 11/2012 | Marcu | G09G 3/006 345/589 |
| 2015/0210100 | A1* | 7/2015 | Hayashi | B41J 29/393 347/19 |
| 2015/0294441 | A1* | 10/2015 | Sakaigawa | G09G 5/10 345/618 |
| 2016/0347006 | A1* | 12/2016 | Kobayashi | B29C 64/20 |
| 2017/0295300 | A1* | 10/2017 | Esashi | H04N 1/405 |

* cited by examiner

FIG.7

| FIRST LUT $\gamma 1$ | SECOND LUT $\gamma 2$ | NUMBER OF COMBINED GRADATION | | | | |
|---|---|---|---|---|---|---|
| | | 0-1023 | 1024-2047 | 2048-3071 | 3072-4095 | TOTAL |
| 0.5 | 0.5 | 767 | 424 | 326 | 274 | 1791 |
| 0.6 | 0.4 | 583 | 177 | 104 | 68 | 932 |
| 0.7 | 0.3 | 530 | 148 | 90 | 62 | 830 |
| 0.8 | 0.2 | 461 | 130 | 78 | 52 | 721 |

FIG.12

| FIRST LUT $\gamma$ 1=0.5 | SECOND LUT $\gamma$ 2=0.5 | NUMBER OF COMBINED GRADATION | | | | |
|---|---|---|---|---|---|---|
| | | 0-1023 | 1024-2047 | 2048-3071 | 3072-4095 | TOTAL |
| 10bit | 10bit | 767 | 424 | 326 | 274 | 1791 |
| 10bit | 12bit | 1023 | 846 | 503 | 333 | 2705 |
| 10bit | 14bit | 1023 | 1024 | 1024 | 1024 | 4095 |

FIG.14

| COLOR | INPUT | IMAGE PROCESSOR CIRCUIT | | DISPLAY PANEL | | COMBINATION | COMPARISON |
|---|---|---|---|---|---|---|---|
| | 255 GRADATION | γ1=0.5 | γ2=0.5 | γ1=2.2 | γ2=2.2 | FIRST GRADATION × SECOND GRADATION/255 | INPUT ^2.2 |
| R | 67 | 130.71 | 130.71 | 58.61 | 58.61 | 13.47 | 13.47 |
| G | 25 | 79.84 | | 19.81 | | 4.56 | 1.54 |
| B | 5 | 35.70 | | 3.37 | | 0.76 | 0.04 |

MISMATCH

FIG.16

| COLOR | INPUT | | IMAGE PROCESSOR CIRCUIT | | | | DISPLAY PANEL | | COMBINATION | COMPARISON |
|---|---|---|---|---|---|---|---|---|---|---|
| | 255 GRADA -TION | | RGB →HSV | γ1=0.5 | HSV →RGB | γ2=0.5 | γ1=2.2 | γ2=2.2 | FIRST GRADATION × SECOND GRADATION ÷255 | INPUT^2.2 |
| R | 67 | H | 0.3225 | 0.3225 | 130.70 | 130.71 | 58.61 | 58.61 | 13.47 | 13.47 |
| G | 25 | S | 0.9253 | 0.9253 | 48.77 | | 6.70 | | 1.54 | 1.54 |
| B | 5 | V | 67 | 130.71 | 9.75 | | 0.19 | | 0.04 | 0.04 |

MATCH

LIQUID CRYSTAL DISPLAY DEVICE

CROSS-REFERENCE TO RELATED APPLICATION

The present application claims priority from Japanese application JP 2017-068369 filed on Mar. 30, 2017, the content of which is hereby incorporated by reference into this application.

TECHNICAL FIELD

The present invention relates to a liquid crystal display device.

BACKGROUND

A technique, in which two display panels overlap each other and an image is displayed on each display panel based on input image data, has been conventionally proposed to improve contrast of a liquid crystal display device (for example, see Unexamined Japanese Patent Publication No. 2008-191269). Specifically, for example, a color image is displayed on a front-side (observer-side) display panel in two display panels disposed back and forth, and a black-and-white image is displayed on a rear-side (backlight-side) display panel, thereby improving contrast.

However, in the conventional liquid crystal display device, in the case that a number of bits of the input image data is larger than a number of driving bits of the two display panels, it is necessary to display the image while the number of bits of the input image data is decreased, which the number of gradations that can be expressed may decreased.

An object of the present disclosure is to suppress the decrease of the number of gradations that can be expressed in a liquid crystal display device in which a plurality of display panels overlap each other.

SUMMARY

According to one aspect of the present disclosure, a liquid crystal display device in which a plurality of display panels are disposed while overlapping each other, and an image being displayed on each of the display panels, the liquid crystal display device includes: an n-bit ($n<m$) driving first display panel that displays a first image based on m-bit input image data; an n-bit driving second display panel that displays a second image based on the m-bit input image data; and an image processor including a first gradation converter that converts a gradation of the m-bit input image data into an n-bit gradation based on a first gamma characteristic of the n-bit driving first display panel, a second gradation converter that converts a gradation of the m-bit input image data into an m1-bit ($m1 \geq m$) gradation based on a second gamma characteristic of the n-bit driving second display panel, and an extension processor that performs extension processing of extending gradation expression with the n bits on the input image data converted into the m1-bit gradation. The n-bit driving first display panel displays the first image based on the n-bit input image data in which the gradation is converted by the first gradation converter, and the n-bit driving second display panel displays the second image based on the n-bit input image data subjected to the extension processing.

In the liquid crystal display device, the first gradation converter may convert the m-bit gradation into the n-bit gradation using a first gamma value, the second gradation converter may convert the m-bit gradation into the m1-bit gradation using a second gamma value, and the first gamma value and the second gamma value may be equal to each other.

In the liquid crystal display device, the extension processing may be dithering of extending the gradation with an average of an area direction.

In the liquid crystal display device, the extension processing may be frame rate controlling of extending the gradation with an average of a time axis direction.

In the liquid crystal display device, the extension processing is smoothing of smoothing a boundary where luminance changes using an average value filter.

In the liquid crystal display device, the image processor may further include a first signal converter that converts the input image data having an RGB format into the input image data having an HSV format and a second signal converter that converts the input image data converted into the HSV format into the input image data having the RGB format, the first gradation converter may convert the gradation of the m-bit input image data into the n-bit gradation based on the first gamma characteristic, the gradation of the m-bit input image data which had been converted into the HSV format by the first signal converter. And the second signal converter may convert the input image data having the HSV format into the RGB format, the input image data having the HSV format which had been converted into the n bit by the first gradation converter.

In the liquid crystal display device, the first gamma value and the second gamma value may be 0.5, and a combined gamma value of a display image in which the first image and the second image are combined may be 2.2.

The present disclosure can suppress the decrease of the number of gradations that can be expressed in the liquid crystal display device in which the plurality of display panels overlap each other.

BRIEF DESCRIPTION OF THE DRAWINGS

FIG. 7 is a table comparing the combination of first gamma value $\gamma 1$ and second gamma value $\gamma 2$ and the number of gradations in which display panel 100 and display panel 200 are combined;

FIG. 12 illustrates the comparison of the numbers of gradations;

FIG. 14 is a table illustrating comparison of image colors in the case that the first gamma processing is performed using the gradation of RGB data;

FIG. 16 is a table illustrating comparison of image colors in the case that the first gamma processing is performed using the gradation of HSV data.

DETAILED DESCRIPTION

Hereinafter, an exemplary embodiment of the present disclosure will be described with reference to the drawings. A liquid crystal display device according to the present exemplary embodiment includes a plurality of display panels that display images, a plurality of driving circuits (a plurality of source drivers and a plurality of gate drivers) that drive the display panels, a plurality of timing controllers that control the driving circuits, an image processor that performs image processing on input image data input from an outside and outputs image data to each of the timing controllers, and a backlight that irradiates the plurality of display panels with light from a rear surface side. There is no limitation to a number of display panels, but it is only necessary to provide at least two display panels. When viewed from an observer side, the plurality of display panels are disposed while overlapping each other in a front-back direction. An image is displayed on each of the display panels. Liquid crystal display device 10 including two display panels will be described below by way of example.

Figure 1:
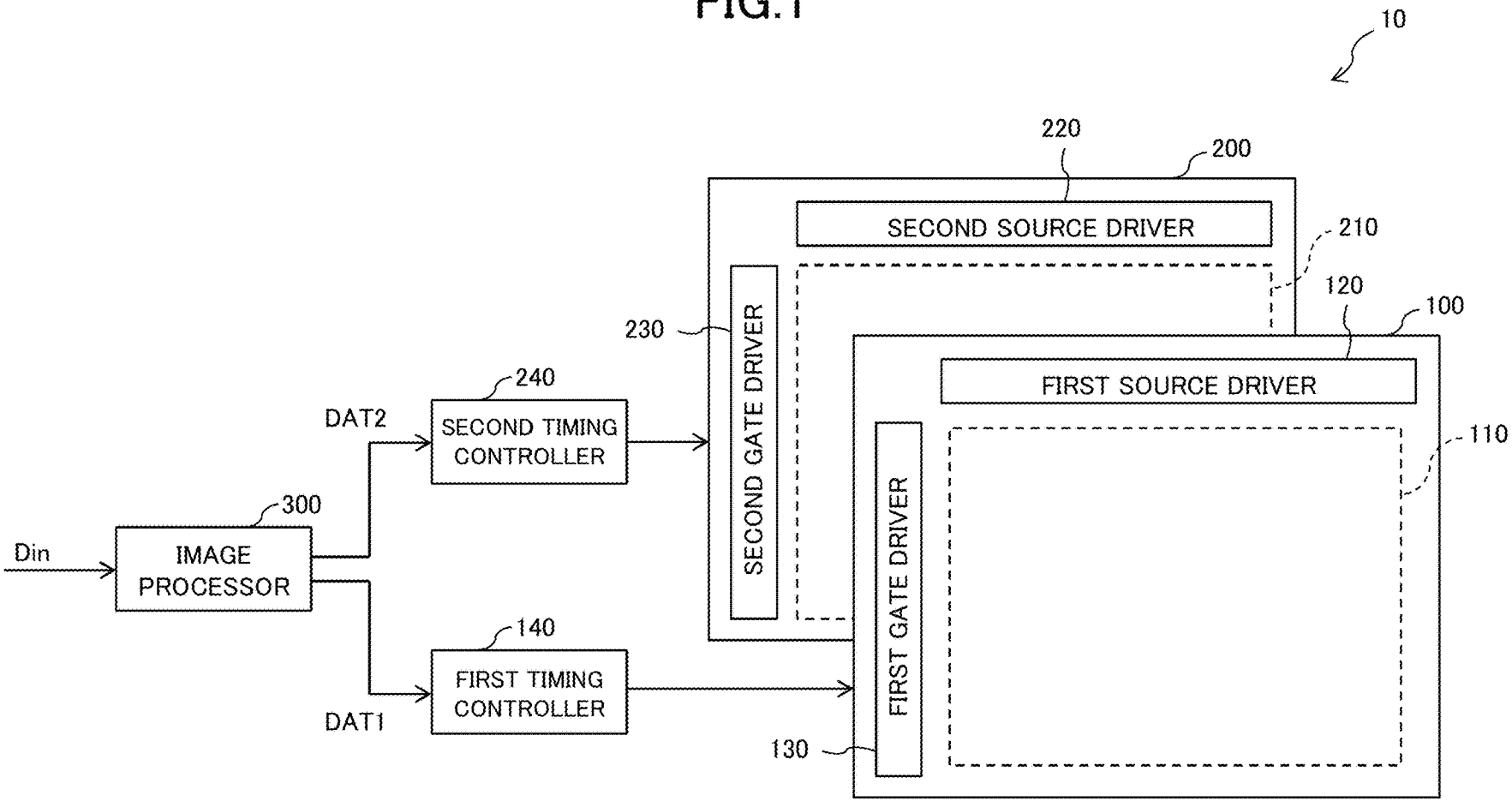
FIG. 1 is a plan view illustrating a schematic configuration of liquid crystal display device according to a present exemplary embodiment.

FIG. 1 is a plan view illustrating a schematic configuration of liquid crystal display device 10 according to the present exemplary embodiment. As illustrated in FIG. 1, liquid crystal display device 10 includes display panel 100 disposed closer to an observer (front side), display panel 200 disposed farther away from the observer (rear side) with respect to display panel 100, first source driver 120 and first gate driver 130 that are provided in display panel 100, first timing controller 140 that controls first source driver 120 and first gate driver 130, second source driver 220 and second gate driver 230 that are provided in display panel 200, second timing controller 240 that controls second source driver 220 and second gate driver 230, and image processor 300 that outputs image data to first timing controller 140 and second timing controller 240. Display panel 100 displays a color image in first image display region 110 according to the input image data, and display panel 200 displays a black-and-white image in second image display region 210 according to the input image data. Image processor 300 receives input image data Din transmitted from an external system (not illustrated), performs image processing (to be described later) on input image data Din, outputs first image data DAT1 to first timing controller 140, and outputs second image data DAT2 to second timing controller 240. Image processor 300 also outputs a control signal (not illustrated in FIG. 1) such as a synchronizing signal to first timing controller 140 and second timing controller 240. First image data DAT1 is image data for displaying the color image, and second image data DAT2 is image data for displaying the black-and-white image. A backlight (not illustrated in FIG. 1) is disposed on a rear surface side of display panel 200. A specific configuration of image processor 300 will be described later.

Figure 2:
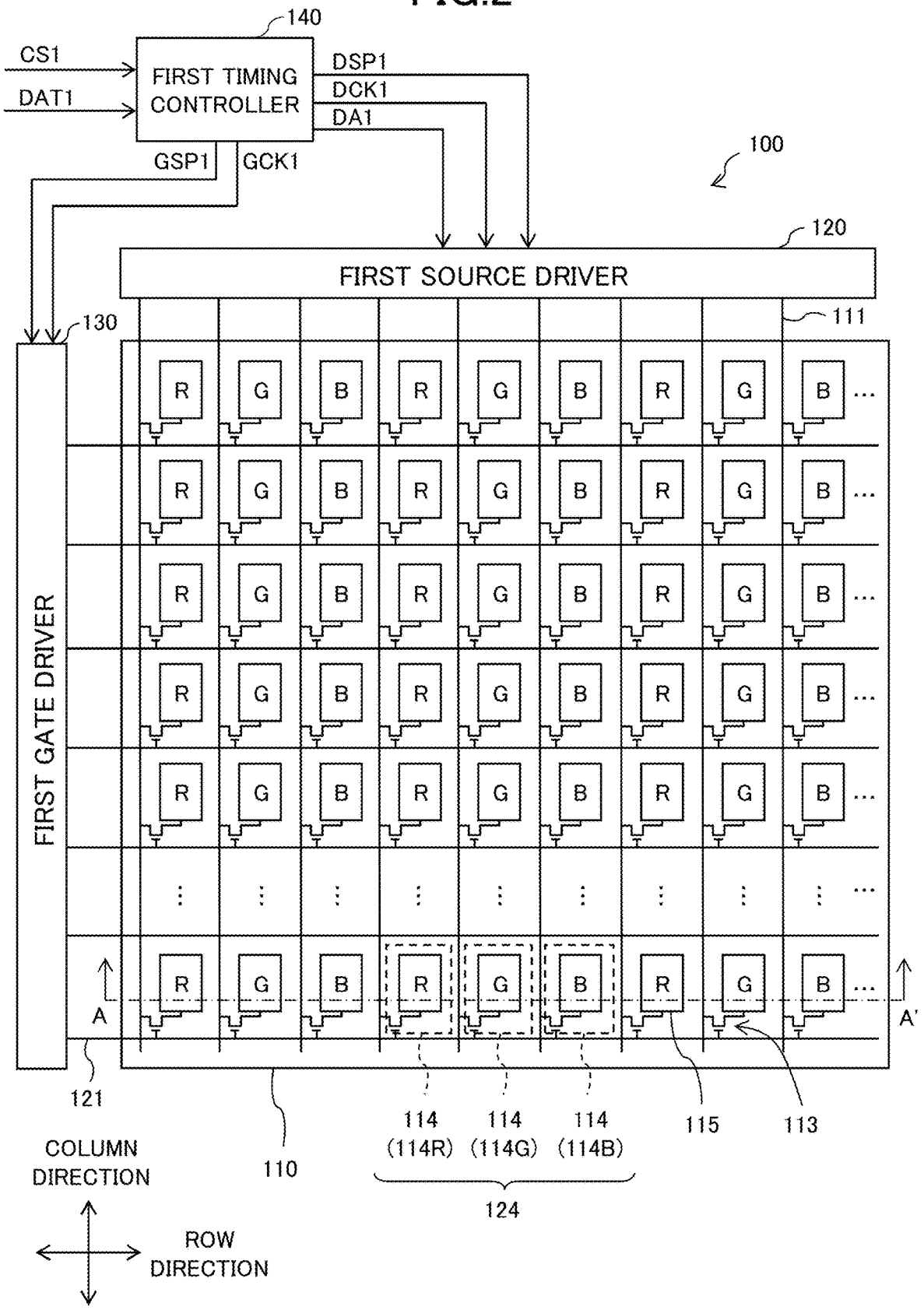
FIG. 2 is a plan view illustrating a schematic configuration of display panel.
Figure 3:
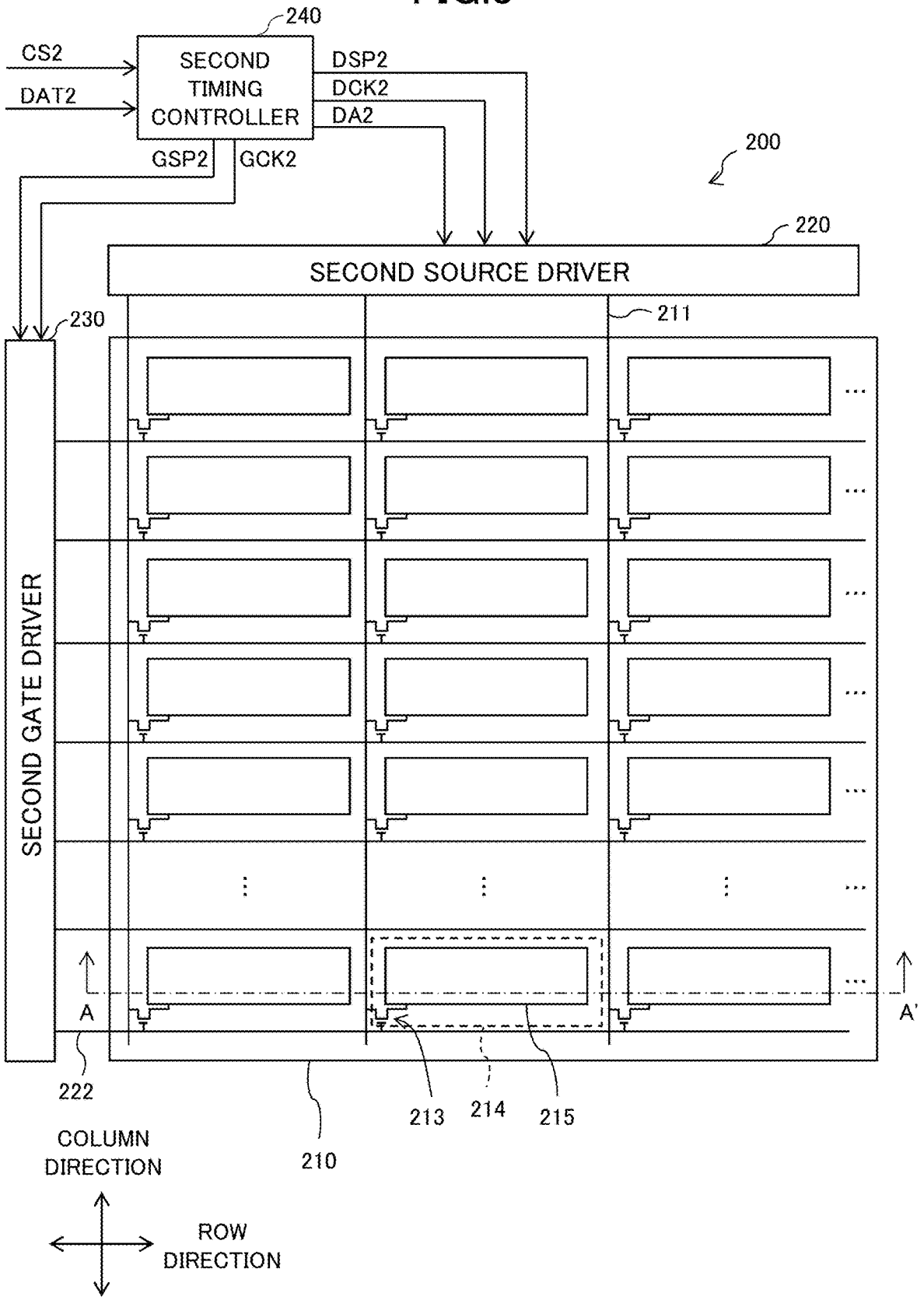
FIG. 3 is a plan view illustrating a schematic configuration of display panel.
Figure 4:
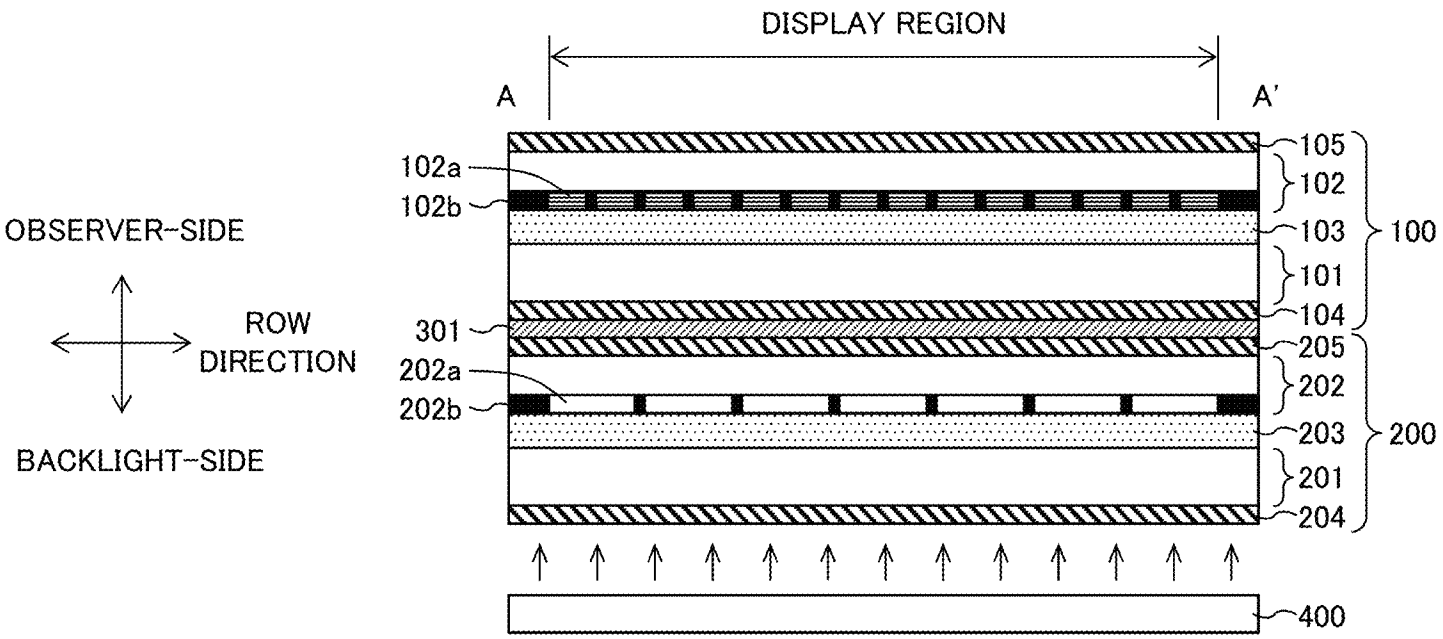
FIG. 4 is a sectional view taken along line A-A' in FIGS. 2 and 3.

FIG. 2 is a plan view illustrating a schematic configuration of display panel 100, and FIG. 3 is a plan view illustrating a schematic configuration of display panel 200. FIG. 4 is a sectional view taken along line A-A' in FIGS. 2 and 3.

A configuration of display panel 100 will be described with reference to FIGS. 2 and 4. As illustrated in FIG. 4, display panel 100 includes thin film transistor substrate 101 disposed on a side of backlight 400, counter substrate 102, which is disposed on the observer side while being opposite to thin film transistor substrate 101, and liquid crystal layer 103 disposed between thin film transistor substrate 101 and counter substrate 102. Polarizing plate 104 is disposed on the side of backlight 400 of display panel 100, and polarizing plate 105 is disposed on the observer side.

In thin film transistor substrate 101, as illustrated in FIG. 2, a plurality of data lines 111 (source line) extending in a first direction (for example, a column direction) and a plurality of gate lines 112 extending in a second direction (for example, a row direction) different from the first direction are formed, and thin film transistor 113 (TFT) is formed near an intersection between each of the plurality of data lines 111 and each of the plurality of gate lines 112. In planar view of display panel 100, a region surrounded by two data lines 111 adjacent to each other and two gate lines 112 adjacent to each other is defined as one sub-pixel 114, and a plurality of sub-pixels 114 are arranged in a matrix form (in the row and column directions). The plurality of data lines 111 are disposed at equal intervals in the row direction, and the plurality of gate lines 112 are disposed at equal intervals in the column direction. In thin film transistor substrate 101, pixel electrode 115 is formed in each sub-pixel 114, and one common electrode (not illustrated) common to the plurality of sub-pixels 114 is formed. A drain electrode constituting thin film transistor 113 is electrically connected to data line 111, a source electrode constituting thin film transistor 113 is electrically connected to pixel electrode 115, and a gate electrode constituting thin film transistor 113 is electrically connected to gate line 112.

As illustrated in FIG. 4, a plurality of color filters 102*a* (colored layer) each of which corresponds to sub-pixel 114 are formed on counter substrate 102. Each color filter 102*a* is surrounded by black matrix 102*b* blocking light transmission. For example, each color filter 102*a* is formed into a rectangular shape. The plurality of color filters 102*a* include red color filters made of a red (R color) material to transmit red light, green color filters made of a green (G color) material to transmit green light, and blue color filters made of a blue (B color) material to transmit blue light. The red color filters, the green color filters, and the blue color filters are repeatedly arrayed in the row direction in this order, identical-color filters are arrayed in the column direction, and black matrix 102*b* is formed at a boundary between color filters 102*a* adjacent to each other in the row direction and the column direction. According to color filter 102*a*, the plurality of sub-pixels 114 include red sub-pixels 114R corresponding to the red color filters, green sub-pixels 114G corresponding to the green color filters, and blue sub-pixels 114B corresponding to the blue color filters as illustrated in FIG. 2. In display panel 100, one pixel 124 is constructed with one red sub-pixel 114R, one green sub-pixel 114G, and one blue sub-pixel 114B, and a plurality of pixels 124 are arranged in a matrix form.

First timing controller 140 has a known configuration. For example, based on first image data DAT1 and first control signal CS1 (such as a clock signal, a vertical synchronizing signal, and a horizontal synchronizing signal), which are output from image processor 300, first timing controller 140 generates various timing signals (data start pulse DSP1, data clock DCK1, gate start pulse GSP1, and gate clock GCK1) to control first image data DA1 and drive of first source driver 120 and first gate driver 130 (see FIG. 2). First timing controller 140 outputs first image data DA1, data start pulse DSP1, and data clock DCK1 to first source driver 120, and outputs gate start pulse GSP1 and gate clock GCK1 to first gate driver 130.

First source driver 120 is an n-bit (hereinafter, n=10) driving driver, and outputs a data signal (data voltage) corresponding to first image data DA1 to data lines 111 based on data start pulse DSP1 and data clock DCK1. First gate driver 130 is an n-bit (hereinafter, n=10) driving driver, and outputs a gate signal (gate voltage) to gate lines 112 based on gate start pulse GSP1 and gate clock GCK1.

The data voltage is supplied from first source driver 120 to each data line 111, and the gate voltage is supplied from first gate driver 130 to each gate line 112. Common voltage Vcom is supplied from a common driver (not illustrated) to the common electrode. When the gate voltage (gate-on voltage) is supplied to gate line 112, thin film transistor 113 connected to gate line 112 is turned on, and the data voltage is supplied to pixel electrode 115 through data line 111 connected to thin film transistor 113. An electric field is generated by a difference between the data voltage supplied to pixel electrode 115 and common voltage Vcom supplied to the common electrode. The liquid crystal is driven by the electric field, and transmittance of backlight 400 is controlled, thereby displaying an image. In display panel 100, the color image is displayed by supply of a desired data voltage to data line 111 connected to pixel electrode 115 of each of red sub-pixel 114R, green sub-pixel 114G, and blue sub-pixel 114B. A known configuration can be applied to display panel 100.

Next, a configuration of display panel 200 will be described below with reference to FIGS. 3 and 4. As illustrated in FIG. 4, display panel 200 includes thin film transistor substrate 201 disposed on the side of backlight 400, counter substrate 202, which is disposed on the observer side while being opposite to thin film transistor substrate 201, and liquid crystal layer 203 disposed between thin film transistor substrate 201 and counter substrate 202. Polarizing plate 204 is disposed on the side of backlight 400 of display panel 200, and polarizing plate 205 is disposed on the observer side. Diffusion sheet 301 or a bonding sheet is disposed between polarizing plate 104 of display panel 100 and polarizing plate 205 of display panel 200.

Figure 5A:
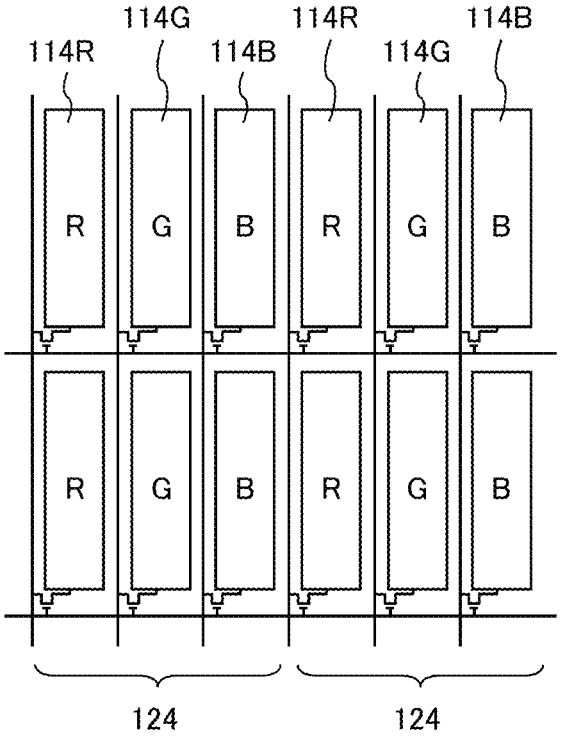
FIGS. 5A and 5B are plan views illustrating another schematic configuration of liquid crystal display device according to a present exemplary embodiment.
Figure 5B:
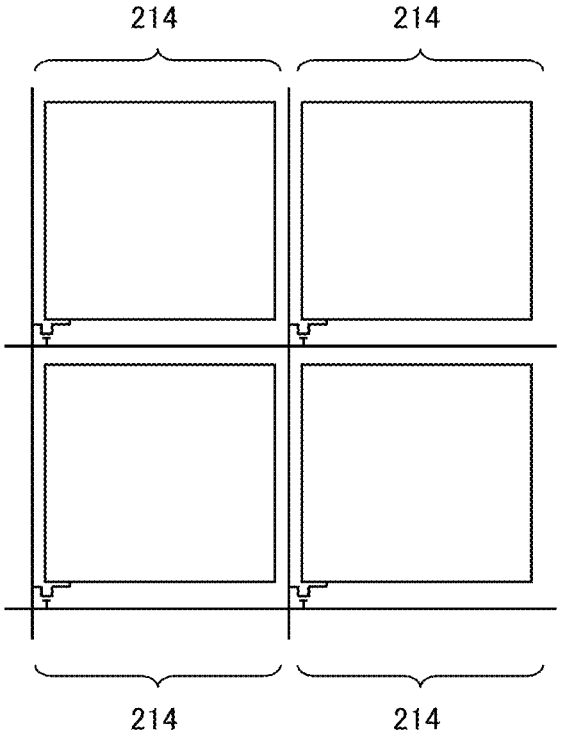

In thin film transistor substrate 201, as illustrated in FIG. 3, a plurality of data lines 211 (source line) extending in the column direction, and a plurality of gate lines 212 extending in the row direction are formed, and thin film transistor 213 is formed near the intersection between each of the plurality of data lines 211 and each of the plurality of gate lines 212. In planar view of display panel 200, a region surrounded by two data lines 211 adjacent to each other and two gate lines 212 adjacent to each other is defined as one pixel 214, and a plurality of pixels 214 are arranged in a matrix form (the row direction and the column direction). The plurality of data lines 211 are disposed at equal intervals in the row direction, and the plurality of gate lines 212 are disposed at equal intervals in the column direction. In thin film transistor substrate 201, pixel electrode 215 is formed in each pixel 214, and one common electrode (not illustrated) common to the plurality of pixels 214 is formed. A drain electrode constituting thin film transistor 213 is electrically connected to data line 211, a source electrode constituting thin film transistor 213 is electrically connected to pixel electrode 215, and a gate electrode constituting thin film transistor 213 is electrically connected to gate line 212. Each pixel 124 of display panel 100 and each pixel 214 of display panel 200 overlap each other in planar view. For example, as illustrated in FIGS. 5A and 5B, one pixel 124 (see FIG. 5A) including red sub-pixel 114R, green sub-pixel 114G, and blue sub-pixel 114B and one pixel 214 (see FIG. 5B) overlap each other in planar view. Each sub-pixel 114 of display panel 100 and each pixel 214 of display panel 200 may be disposed on one-to-one correspondence.

As illustrated in FIG. 4, in counter substrate 202, black matrix 202*b* blocking light transmission is formed at a position corresponding to a boundary of each pixel 214. The color filter is not formed in region 202*a* surrounded by black matrix 202*b*. For example, an overcoat film is formed in region 202*a*.

Second timing controller 240 has a known configuration. For example, based on second image data DAT2 and second control signal CS2 (such as a clock signal, a vertical synchronizing signal, and a horizontal synchronizing signal), which are output from image processor 300, second timing controller 240 generates various timing signals (data start pulse DSP2, data clock DCK2, gate start pulse GSP2, and gate clock GCK2) to control second image data DA2 and drive of second source driver 220 and second gate driver 230 (see FIG. 3). Second timing controller 240 outputs second image data DA2, data start pulse DSP2, and data clock DCK2 to second source driver 220, and outputs gate start pulse GSP2 and gate clock GCK2 to second gate driver 230.

Second source driver 220 is an n-bit (hereinafter, n=10) driving driver, and outputs the data voltage corresponding to second image data DA2 to data lines 211 based on data start pulse DSP2 and data clock DCK2. Second gate driver 230 is an n-bit (hereinafter, n=10) driving driver, and outputs the gate voltage to gate lines 212 based on gate start pulse GSP2 and gate clock GCK2.

The data voltage is supplied from second source driver 220 to each data line 211, and the gate voltage is supplied from second gate driver 230 to each gate line 212. Common voltage Vcom is supplied from the common driver to the common electrode. When the gate voltage (gate-on voltage) is supplied to gate line 212, thin film transistor 213 connected to gate line 212 is turned on, and the data voltage is supplied to pixel electrode 215 through data line 211 connected to thin film transistor 213. An electric field is generated by a difference between the data voltage supplied to pixel electrode 215 and common voltage Vcom supplied to the common electrode. The liquid crystal is driven by the electric field, and transmittance of backlight 400 is controlled, thereby displaying an image. The black-and-white image is displayed on display panel 200. A known configuration can be applied to display panel 200.

Figure 6:
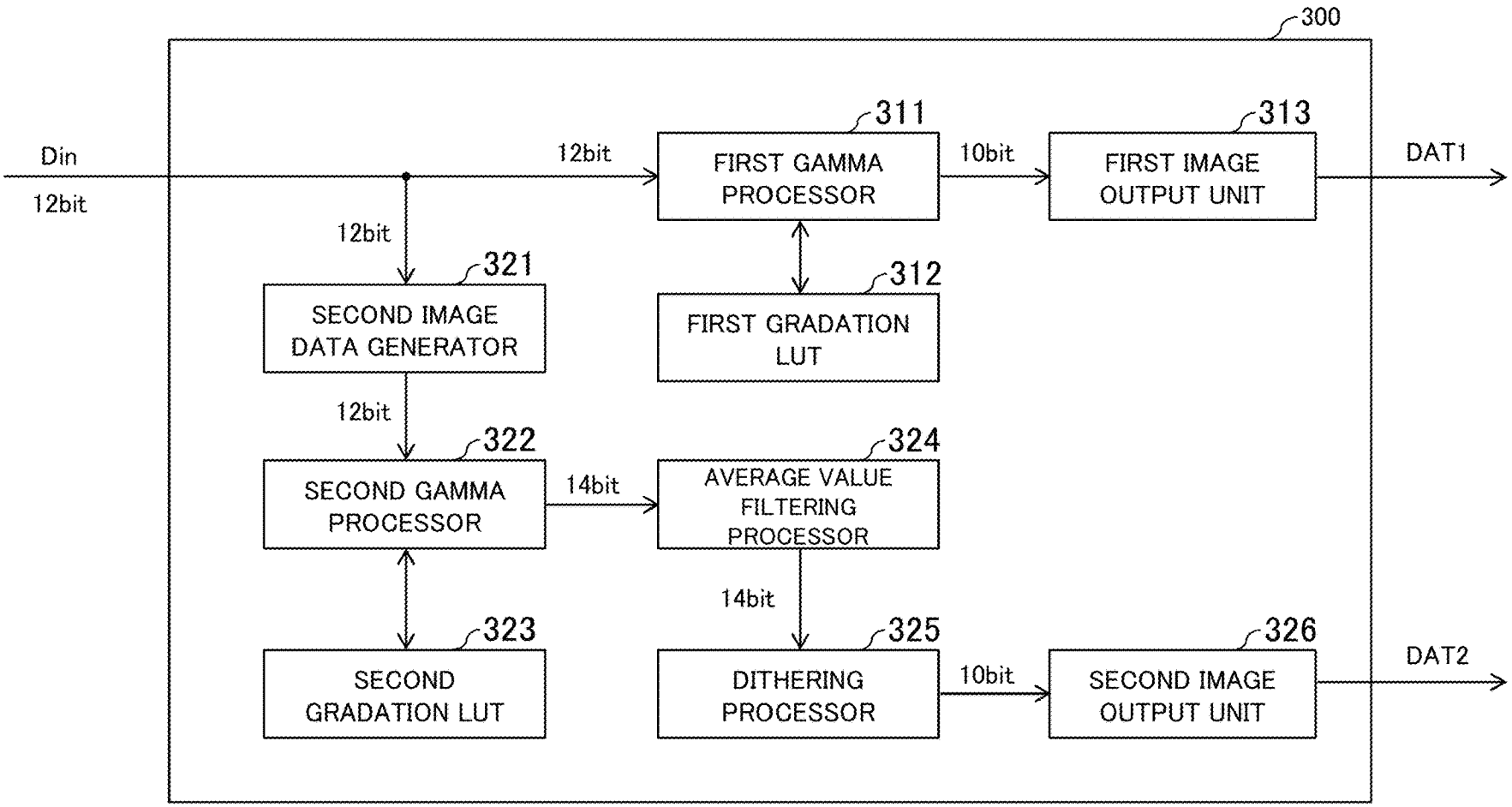
FIG. 6 is a block diagram illustrating a specific configuration of image processor.

FIG. 6 is a block diagram illustrating a specific configuration of image processor 300. Image processor 300 includes first gamma processor 311 (first gradation converter), first gradation look-up table (LUT) 312, first image output unit 313, second image data generator 321, second gamma processor 322 (second gradation converter), second gradation look-up table (LUT) 323, average value filtering processor 324, dithering processor 325 (extension processor), and second image output unit 326. Image processor 300 performs image processing (to be described later) based on m-bit (hereinafter, m=12) input image data Din to generate, for example, first image data DAT1 of an n-bit (n=10) color image for display panel 100 and second image data DAT2 of an n-bit (n=10) black-and-white image for display panel 200. Image processor 300 decides a gradation (first gradation) of first image data DAT1 and a gradation (second gradation) of second image data DAT2 such that a combined gamma value (γ value) of the display image (combined gradation), in which the color image and the black-and-white image are combined, becomes a desired value (hereinafter, γ=2.2).

When receiving 12-bit input image data Din transmitted from an external system, image processor 300 transfers input image data Din to first gamma processor 311 and second image data generator 321. For example, input image data Din includes luminance information (gradation information) and color information. The color information is information designating the color. For example, in the case that input image data Din is constructed with 12 bits, each of a plurality of colors including the R color, the G color, and the B color can be expressed by values ranging from 0 to 4095. The plurality of colors include at least the R color, the G color, and the B color, and may further include a W (white) color and/or a Y (yellow) color. In the case that the plurality of colors include the R color, the G color, and the B color, the color information about input image data Din is expressed by an "RGB value" ([R value, G value, B value]). For example, the RGB value is expressed by [4095, 4095, 4095] in the case that the color corresponding to input image data Din is white, the RGB value is expressed by [4095, 0, 0] in the case that the color corresponding to input image data Din is red, and the RGB value is expressed by [0, 0, 0] in the case that the color corresponding to input image data Din is black.

When obtaining 12-bit input image data Din, second image data generator 321 generates black-and-white image data corresponding to the black-and-white image using a maximum value (the R value, the G value, or the B value) in each color value (in this case, the RGB value of [R value, G value, B value]) indicating the color information about input image data Din. Specifically, in the RGB value corresponding to target pixel 214, second image data generator 321 generates the black-and-white image data by setting the maximum value in the RGB values to the value of target pixel 214. Second image data generator 321 outputs the generated black-and-white image data to second gamma processor 322.

When obtaining the 12-bit black-and-white image data generated by second image data generator 321, second gamma processor 322 refers to second gradation LUT 323 to decide the gradation (second gradation) corresponding to the 14-bit black-and-white image data (second gamma processing). For example, second gamma processor 322 converts the gradation of the 12-bit black-and-white image data into the gradation of the 14-bit black-and-white image data using the gamma value (second gamma value γ2) set based on a gamma characteristic (second gamma characteristic) for display panel 200. Second gamma processor 322 outputs the black-and-white image data subjected to the second gamma processing to average value filtering processor 324.

When obtaining the 12-bit input image data Din from an external system, first gamma processor 311 refers to first gradation LUT 312 to decide the gradation (first gradation) corresponding to the 10-bit color image data (first gamma processing). For example, first gamma processor 311 converts the gradation of the 12-bit color image data into the gradation of the 10-bit color image data using the gamma value (first gamma value γ1) set based on a gamma characteristic (first gamma characteristic) for display panel 100. First gamma processor 311 outputs the color image data subjected to the first gamma processing to first image output unit 313. First gamma processor 311 may decide the first gradation based on the second gradation of the black-and-white image data subjected to the second gamma processing by the second gamma processor 322.

A method for setting first gamma value γ1 and second gamma value γ2 will be described below. For example, first gamma value γ1 and second gamma value γ2 are set such that a combined image (display image) in which the color image and the black-and-white image are combined has the combined gamma value of 2.2. For example, assuming that Lm is luminance of display panel 100 and that Ls is luminance of display panel 200 in the case that both the first gamma characteristic of display panel 100 and the second gamma characteristic of display panel 200 have the gamma value of 2.2, combined luminance is expressed by Lm×Ls. The following equation is given when combined luminance Lm×Ls is expressed by input signal Din, first gamma value γ1, and second gamma value γ2.

$$Lm \times Ls = (Din\hat{}\gamma 1)\hat{}2.2 \times (Din\hat{}\gamma 2)\hat{}2.2$$

$$= Din\hat{}(\gamma 1 \times 2.2) \times Din\hat{}(\gamma 2 \times 2.2)$$

$$= Din\hat{}(\gamma 1 \times 2.2 + \gamma 2 \times 2.2)$$

Thus, first gamma value γ1 and second gamma value γ2 are set such that (γ1×2.2+γ2×2.2)=2.2 is obtained.

Figure 8:
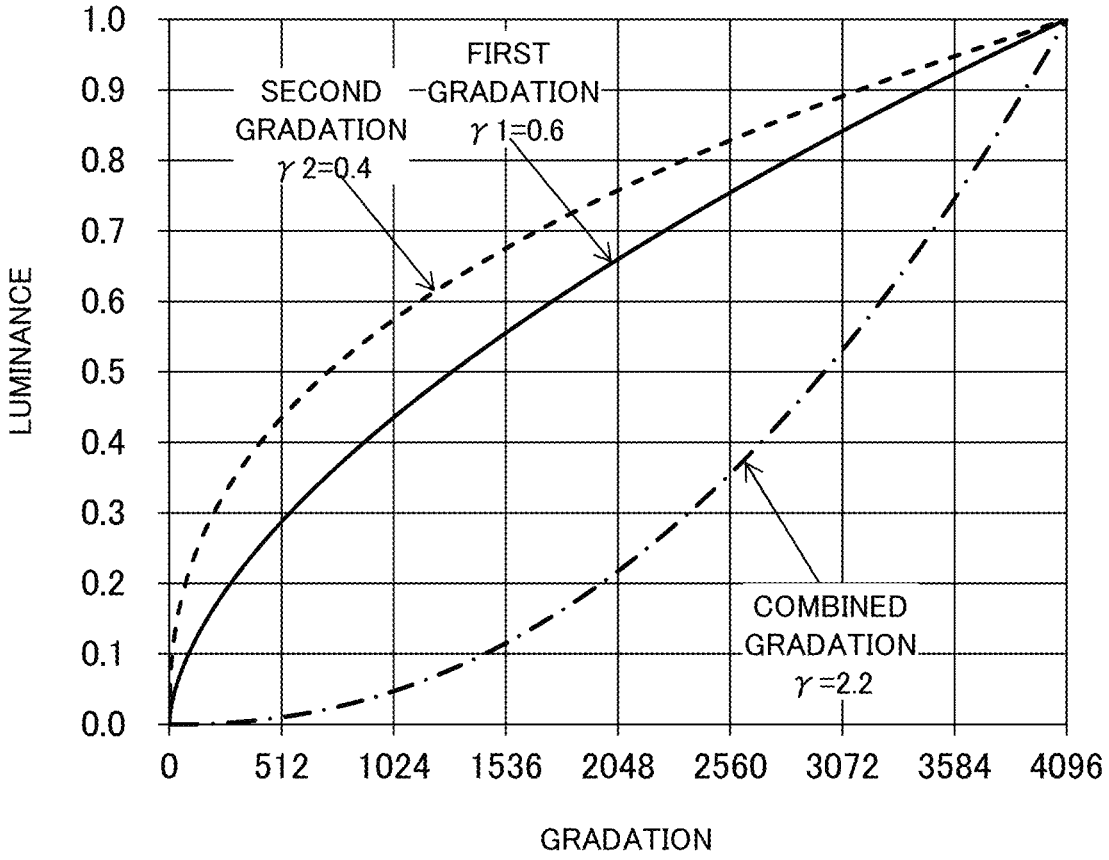
FIG. 8 is a graph illustrating a gamma characteristic in the case that first gamma value $\gamma 1$ is 0.6 while second gamma value $\gamma 2$ is 0.4.
Figure 9:
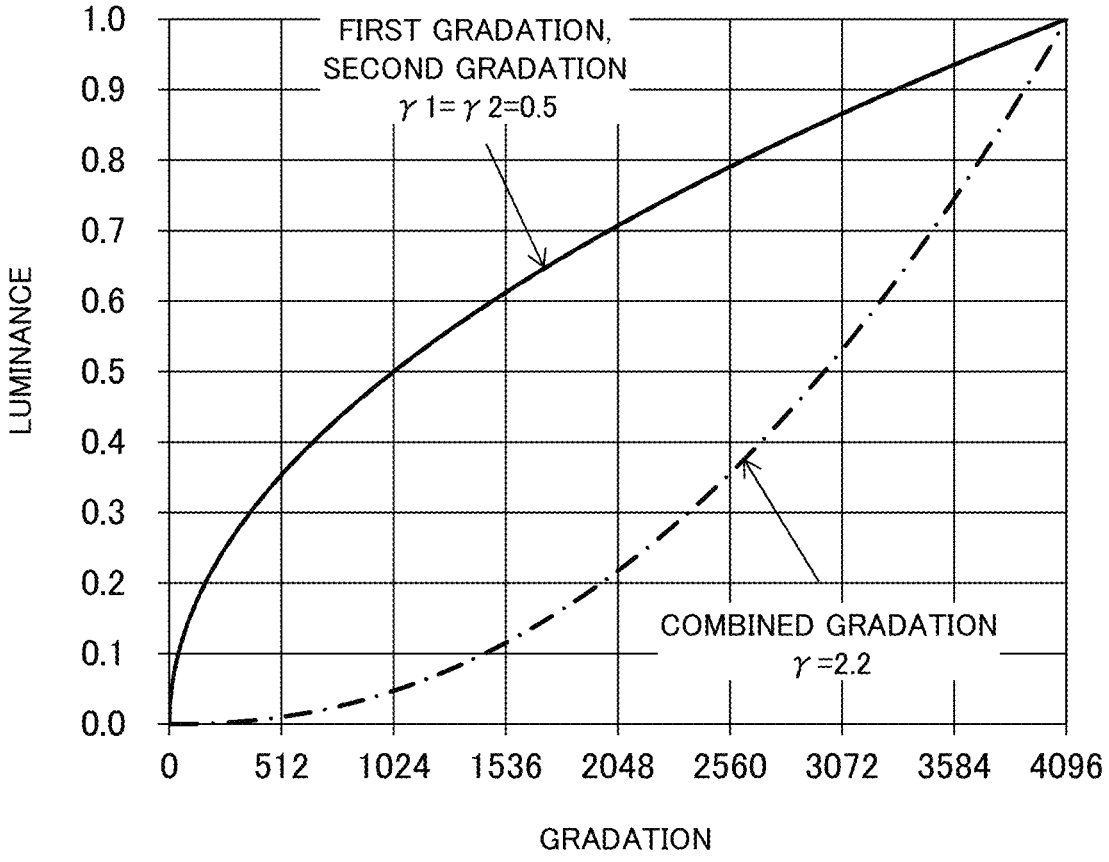
FIG. 9 is a graph illustrating a gamma characteristic in the case that both first gamma value $\gamma 1$ and second gamma value $\gamma 2$ are 0.5.

Preferably a combination of first gamma value γ1 and second gamma value γ2 having a maximum number of gradations is selected because a number of gradations that can be expressed by liquid crystal display device 10 changes according to the combination of first gamma value γ1 and second gamma value γ2. FIG. 7 is a table comparing the combination of first gamma value γ1 and second gamma value γ2 and the number of gradations in which display panel 100 and display panel 200 are combined. FIG. 7 illustrates a comparison of the numbers of gradations when the combination of first gamma value γ1 and second gamma value γ2 is changed in the case that both first gradation LUT 312 and second gradation LUT 323 convert the gradation of the 12-bit image data (input image data) into the gradation of the 10-bit image data (output image data). FIG. 8 is a graph illustrating a gamma characteristic as an example of the combination in FIG. 7 in the case that first gamma value γ1 is 0.6 while second gamma value γ2 is 0.4, and FIG. 9 is a graph illustrating a gamma characteristic in the case that both first gamma value γ1 and second gamma value γ2 are 0.5. As illustrated in the table of FIG. 7, the number of gradations is maximized when both first gamma value γ1 and second gamma value γ2 are 0.5. In the exemplary embodiment, first gamma value γ1 and second gamma value γ2 are set to 0.5.

The gradation in FIG. 7 is given by the following equation. The input image data is set to Din (0 to 4095), and first gamma value γ1 and second gamma value γ2 are set to 0.5.

$$\text{Gradation of color image data} = \text{int}(((Din/4095)\hat{}0.5) \times 1023)$$

$$\text{Gradation of black-and-white image data} = \text{int}(((Din/4095)\hat{}0.5) \times 1023 + 0.5)$$

For example, in the case that the gradation of input image data Din ranges from 213 to 217, the input gradation is converted as follows.

(1) For input image data Din=213 gradations

Calculated value of color image data=233.31, calculated value of black-and-white image data=233.81

Converted gradation of color image data=233 gradations, converted gradation of black-and-white image data=234 gradations (2) For input image data Din=214 gradations Calculated value of color image data=233.85, calculated value of black-and-white image data=234.35

Converted gradation of color image data=234 gradations, converted gradation of black-and-white image data=234 gradations (3) For input image data Din=215 gradations Calculated value of color image data=234.40, calculated value of black-and-white image data=234.9

Converted gradation of color image data=234 gradations, converted gradation of black-and-white image data=235 gradations (4) For input image data Din=216 gradations Calculated value of color image data=234.95, calculated value of black-and-white image data=235.45

Converted gradation of color image data=235 gradations, converted gradation of black-and-white image data=235 gradations (5) For input image data Din=217 gradations Calculated value of color image data=235.49, calculated value of black-and-white image data=235.99

Converted gradation of color image data=235 gradations, converted gradation of black-and-white image data=236 gradations When obtaining the 14-bit black-and-white image data subjected to the second gamma processing, average value filtering processor 324 performs smoothing on the black-and-white image data using an average value filter common to all pixels 214 in each frame. For example, using the 11-by-11 pixel region constructed with each 11 pixels on the right, left, top, and bottom around each pixel 214 (target pixel) as a filter size, average value filtering processor 324 performs processing for setting an average luminance in the filter size to the luminance of pixel 214 (target pixel) with respect to each pixel 214 (target pixel). Although the filter size is not limited to the 11-by-11 pixel region, all pixels 214 are set to the common filter size in each frame. The filter is not limited to the square shape, but the filter may be formed into a circular shape. A high-frequency component is deleted through the smoothing, so that a luminance change can be smoothed. Average value filtering processor 324 outputs the 14-bit black-and-white image data subjected to the smoothing to dithering processor 325.

Figure 10:
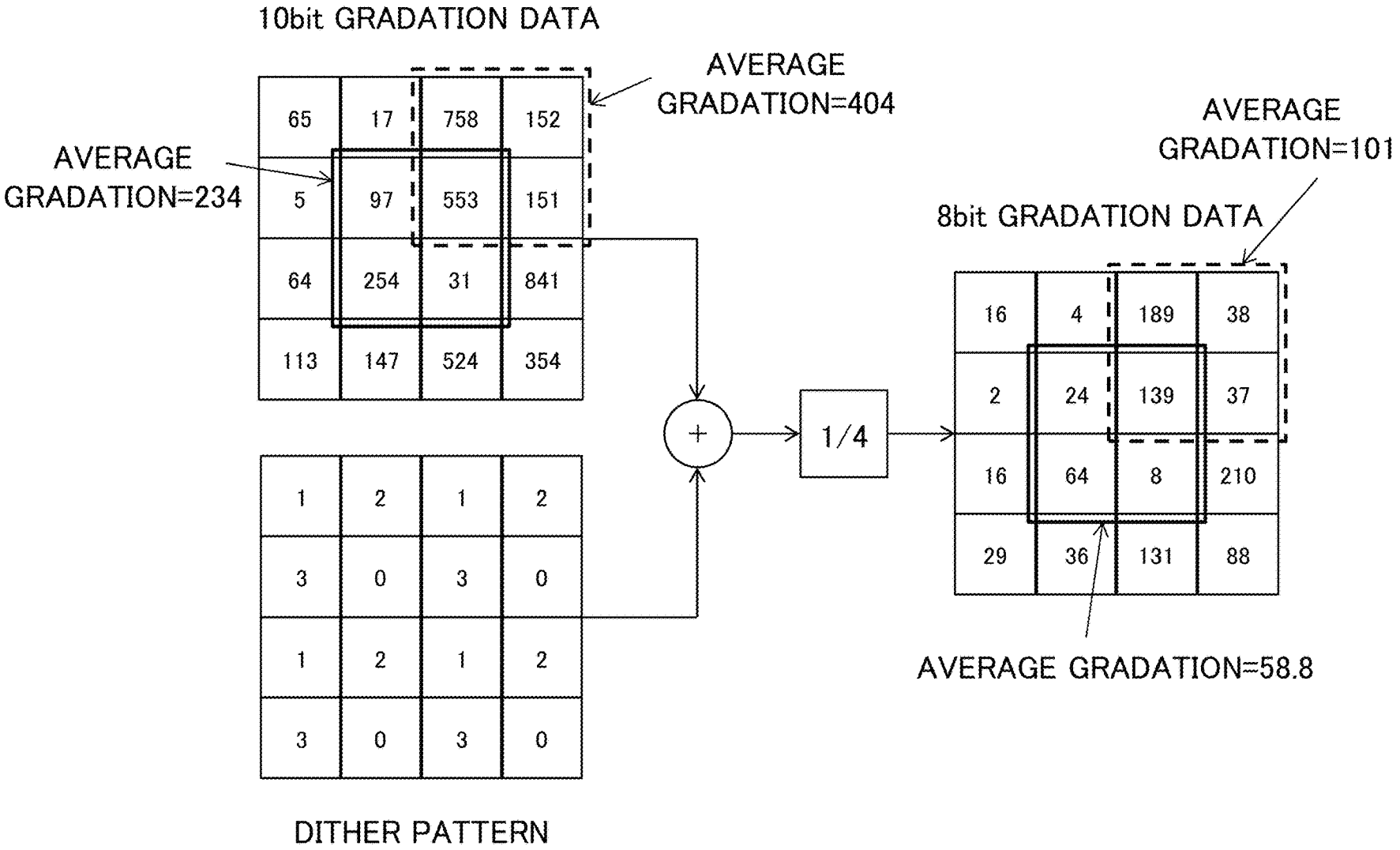
FIG. 10 is a view illustrating an example of the dithering.
Figure 11:
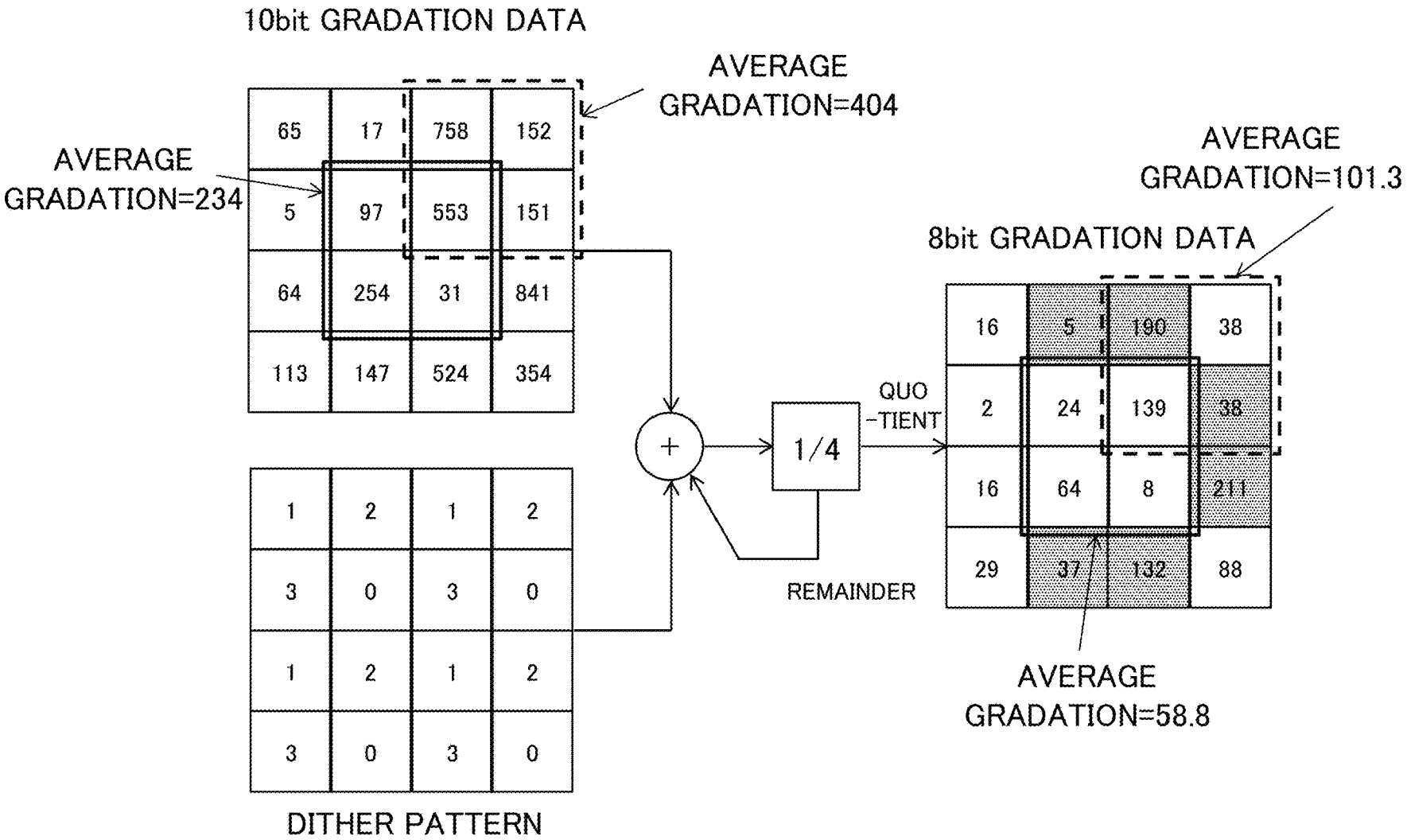
FIG. 11 is a view illustrating an example of the dithering by the error diffusion method.

When obtaining the 14-bit black-and-white image data subjected to the smoothing, dithering processor 325 performs extension processing (dithering) of extending gradation expression on the black-and-white image data. For example, dithering processor 325 extends the gradation with an average of an area direction using a predetermined dither pattern while converting the 14-bit black-and-white image data into the 10-bit black-and-white image data. The 12-bit gradation of input image data Din can simulatively be expressed by 10 bits through the dithering. FIG. 10 is a view illustrating an example of the dithering. FIG. 10 illustrates the case that the 10-bit gradation data is converted into the 8-bit gradation data. An error diffusion method may be adopted to the dithering. FIG. 11 is a view illustrating an example of the dithering by the error diffusion method. In the error diffusion method, the image quality can be improved by performing feedback processing of diffusing an error generated by the conversion processing into the 8-bit gradation data to peripheral pixels. A known technique can be applied to the dithering and the error diffusion method. Dithering processor 325 outputs the 10-bit black-and-white image data subjected to the extension processing to second image output unit 326.

First image output unit 313 outputs the 10-bit color image data (first gradation) to first timing controller 140 as first image data DAT1. Second image output unit 326 outputs the 10-bit black-and-white image data (second gradation) to second timing controller 240 as second image data DAT2. Image processor 300 outputs first control signal CS1 to first timing controller 140, and outputs second control signal CS2 to second timing controller 240 (see FIGS. 2 and 3). In addition to the above pieces of processing, image processor 300 may perform extension filtering of extending a high luminance region on the black-and-white image data output from second image data generator 321 or differential filtering of detecting (emphasizing) a boundary (edge) where the luminance changes largely on the black-and-white image data output from second gamma processor 322.

As described above, image processor 300 of the exemplary embodiment converts 12-bit input image data Din into the 10-bit gradation data (color image data) based on first gamma value $\gamma 1$ (=0.5), converts 12-bit input image data Din into the 14-bit gradation data (black-and-white image data) based on second gamma value $\gamma 2$ (=0.5), and then performs the dithering to convert the 14-bit gradation data into the 10-bit gradation data. Consequently, as illustrated in the table of FIG. 12, the number of combined gradations becomes the same number of gradations (4095) as the number of gradations that can be expressed using 12-bit input image data Din. FIG. 12 illustrates the comparison of the numbers of gradations when the combination of the number of bits of output image data of first gradation LUT 312 and the number of bits of output image data of second gradation LUT 323 is changed in the case that first gamma value $\gamma 1$ and second gamma value $\gamma 2$ are set to 0.5 while the input image data to first gradation LUT 312 and second gradation LUT 323 is set to 12 bits.

Image processor 300 is not limited to the above configuration. For example, second gamma processor 322 of image processor 300 may convert the gradation of 12-bit input image data Din into the gradation of the 12-bit black-and-white image data using second gamma value $\gamma 2$ (=0.5), and dithering processor 325 may convert the gradation of the 12-bit black-and-white image data into the gradation of the 10-bit black-and-white image data. According to this configuration, the number of combined gradation becomes 2705 as illustrated in the table of FIG. 12.

Thus, image processor 300 generates first image data DAT1 by converting the gradation of m-bit input image data Din into the n-bit ($n<m$) gradation based on the first gamma characteristic (gamma value 2.2) of display panel 100, converts the gradation of m-bit input image data Din into the m1-bit ($m1 \geq m$) gradation based on the second gamma characteristic (gamma value 2.2) of display panel 200, and generates second image data DAT2 by performing the extension processing of extending the n-bit gradation expression on input image data Din converted into the m1-bit gradation. Consequently, even if the number of bits (m bits) of input image data Din is larger than the numbers of driving bits (n bits) of display panel 100 and display panel 200, the number of gradations (in the example, 2705 or 4095) that can be expressed can be increased larger than the number of gradations (in the example, 1791) corresponding to the numbers of driving bits of display panel 100 and display panel 200.

Figure 13:
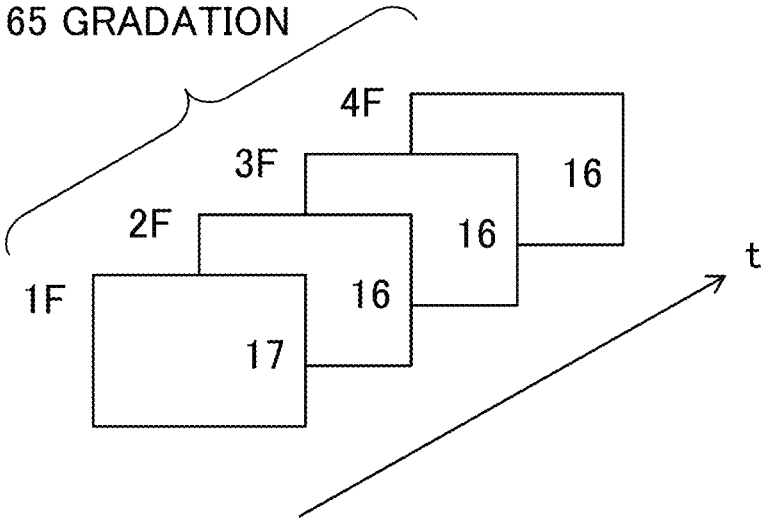
FIG. 13 is a view illustrating an example of the frame rate controlling.

The extension processing of extending the gradation expression is not limited to the dithering. For example, frame rate controlling (FRC) may be adopted to the extension processing. FIG. 13 is a view illustrating an example of the frame rate controlling. For example, in the case that the 10-bit image data expressing 65 gradations is expressed by the 8-bit image data, the 10-bit image data is averaged in a time axis direction (for example, four frames) to express the 65 gradations. A known method can be adopted to the frame rate controlling.

At this point, a color shift is generated in the case that first gamma processor 311 performs the first gamma processing using the gradation of RGB data while input image data Din has the RGB format. FIG. 14 is a table illustrating comparison of image colors in the case that the first gamma processing is performed using the gradation of RGB data. FIG. 14 illustrates the case that the RGB value is [67, 25, 5] in 8-bit (256-gradation) input image data Din as an example. In this case, it is found that the color shift is generated because G gradation and B gradation of the combined image are different from G gradation and B gradation corresponding to input image data Din.

Figure 15:
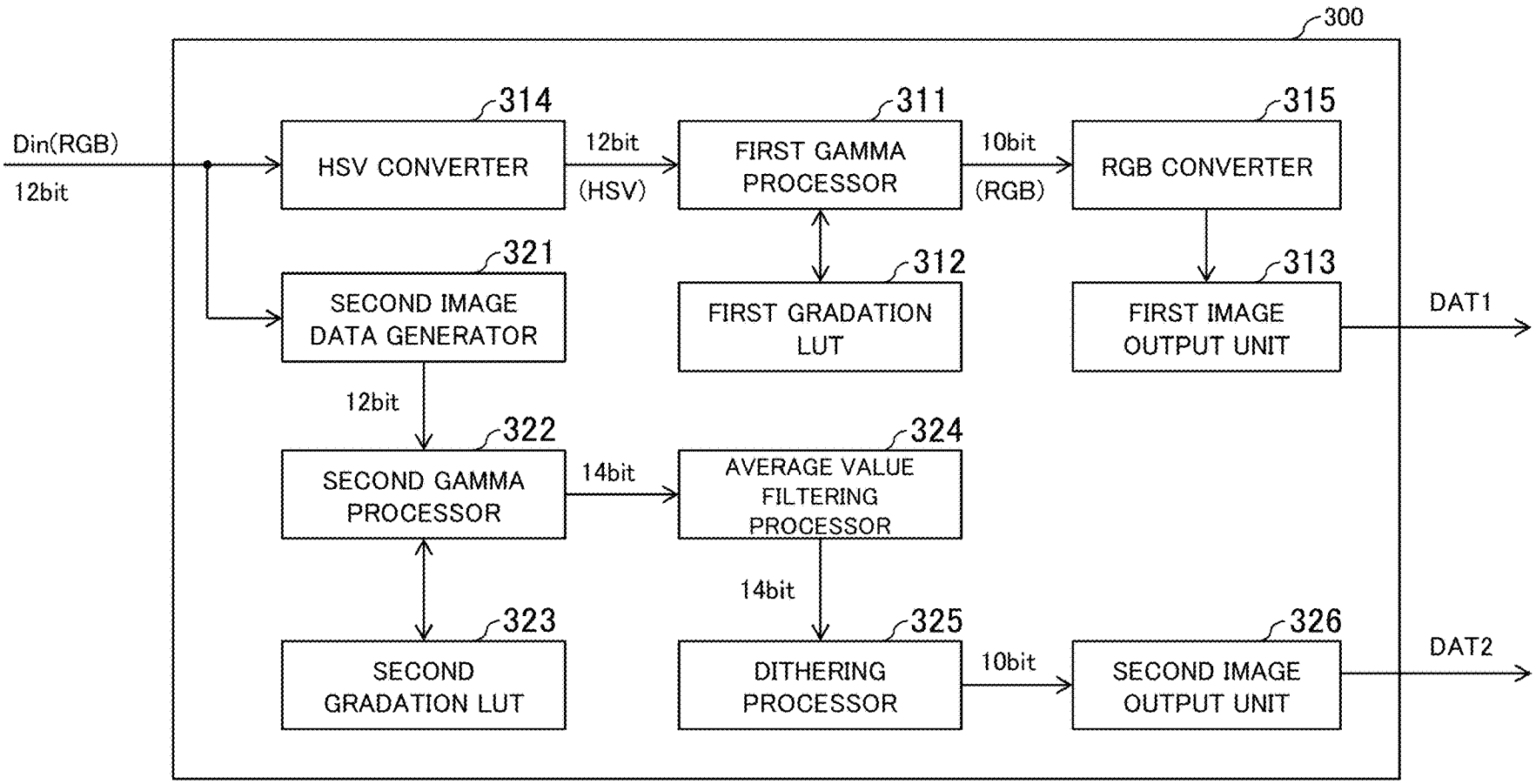
FIG. 15 is a block diagram illustrating another specific configuration of image processor.

On the other hand, in image processor 300 of the exemplary embodiment, as illustrated in FIG. 15, preferably HSV converter 314 (first signal converter) that converts the RGB format into an HSV format (hue, saturation, value) is provided at a preceding stage of first gamma processor 311, and RGB converter 315 (second signal converter) that converts the HSV format into the RGB format is provided at a subsequent stage of first gamma processor 311. FIG. 16 is a table illustrating comparison of image colors in the case that the first gamma processing is performed using the gradation of HSV data. In the configuration of FIG. 15, as can be seen from FIG. 16, each gradation of the combined image agrees with the gradation corresponding to input image data Din to prevent the color shift.

Image processor 300 is not limited to the above configuration. Dithering processor 325 may be eliminated in the configuration of FIG. 6. In this case, average value filtering processor 324 performs the smoothing using an average value filter, thereby extending the gradation expression. That is, average value filtering processor 324 acts as an extension processor that performs extension processing of extending the gradation expression. This configuration is effective in the case that the input image has a gradation difference.

In liquid crystal display device 10 of the exemplary embodiment, display panel 100 may be disposed at a position (rear side) farther away from the observer, and display panel 200 may be disposed at a position (front side) close to the observer. Both display panel 100 and display panel 200 may display the black-and-white image.

While there have been described what are at present considered to be certain embodiments of the application, it will be understood that various modifications may be made thereto, and it is intended that the appended claims cover all such modifications as fall within the true spirit and scope of the invention.

What is claimed is:

1. A liquid crystal display device in which a plurality of display panels are disposed while overlapping each other, and an image being displayed on each of the display panels, the liquid crystal display device comprising:

an n-bit (n<m) driving first display panel that displays a first image based on m-bit input image data;

an n-bit driving second display panel that displays a second image based on the m-bit input image data; and an image processor including a first signal converter that converts input image data having a RGB format into input image data having an HSV format, a first gradation converter that converts a gradation of the m-bit input image data having the HSV format into an n-bit gradation based on a first gamma characteristic of the n-bit driving first display panel, a second signal converter that converts the input image data converted into the HSV format into the input image data having the RGB format, a second gradation converter that converts a gradation of the m-bit input image data having the RGB format into an m1-bit (m1≥m) gradation based on a second gamma characteristic of the n-bit driving second display panel, and an extension processor that performs extension processing of extending gradation expression to the n bits on the input image data converted into the m1-bit gradation, wherein the n-bit driving first display panel displays the first image based on n-bit input image data in which the gradation is converted by the first gradation converter in HSV format, the n-bit driving second display panel displays the second image based on n-bit input image data in which the gradation is converted by the second gradation converter in RGB format, subjected to the extension processing, the first gradation converter converts the m-bit gradation into the n-bit gradation using a first gamma value, the second gradation converter converts the m-bit gradation into the m1-bit gradation using a second gamma value, the first gamma value and the second gamma value are equal to each other, the first gamma value and the second gamma value are 0.5, and a combined gamma value of a display image in which the first image and the second image are combined is 2.2.

2. The liquid crystal display device according to claim 1, wherein the extension processing is dithering of extending the gradation with an average of an area direction.

3. The liquid crystal display device according to claim 1, wherein the extension processing is frame rate controlling of extending the gradation with an average of a time axis direction.

4. The liquid crystal display device according to claim 1, wherein the extension processing is smoothing of smoothing a boundary where luminance changes using an average value filter.

5. A liquid crystal display device in which a plurality of display panels are disposed while overlapping each other, and an image being displayed on each of the display panels, the liquid crystal display device comprising:

an n-bit (n<m) driving first display panel that displays a first image based on m-bit input image data;

an n-bit driving second display panel that displays a second image based on the m-bit input image data; and an image processor including a first gradation converter that converts a gradation of the m-bit input image data into an n-bit gradation based on a first gamma characteristic of the n-bit driving first display panel, a second gradation converter that converts a gradation of the m-bit input image data into an m1-bit (m1≥m) gradation based on a second gamma characteristic of the n-bit driving second display panel, and an extension processor that performs extension processing of extending gradation expression to the n bits on the input image data converted into the m1-bit gradation, wherein the n-bit driving first display panel displays the first image based on n-bit input image data in which the gradation is converted by the first gradation converter, the n-bit driving second display panel displays the second image based on n-bit input image data subjected to the extension processing, the first gradation converter converts the m-bit gradation into the n-bit gradation using a first gamma value, the second gradation converter converts the m-bit gradation into the m1-bit gradation using a second gamma value, the first gamma value and the second gamma value are equal to each other, the first gamma value and the second gamma value are 0.5, and a combined gamma value of a display image in which the first image and the second image are combined is 2.2.

* * * * *